US009271551B2

(12) United States Patent
Ma

(10) Patent No.: US 9,271,551 B2
(45) Date of Patent: Mar. 1, 2016

(54) UMBRELLA RIB CONNECTOR

(71) Applicant: Oliver Joen-an Ma, Arcadia, CA (US)

(72) Inventor: Oliver Joen-an Ma, Arcadia, CA (US)

( * ) Notice: Subject to any disclaimer, the term of this patent is extended or adjusted under 35 U.S.C. 154(b) by 0 days.

(21) Appl. No.: 14/029,377

(22) Filed: Sep. 17, 2013

(65) Prior Publication Data

US 2014/0305476 A1 Oct. 16, 2014

(30) Foreign Application Priority Data

Apr. 12, 2013 (CN) ..... 2013 2 0188172 U

(51) Int. Cl.
*A45B 25/02* (2006.01)

(52) U.S. Cl.
CPC ..... *A45B 25/02* (2013.01)

(58) Field of Classification Search
CPC ..... A45B 25/02
USPC ..... 135/28, 29, 30, 32
See application file for complete search history.

(56) References Cited

U.S. PATENT DOCUMENTS

| | | | | |
|---|---|---|---|---|
| 634,018 | A * | 10/1899 | McGee | 135/30 |
| 878,270 | A | 2/1908 | Blake et al. | |
| 950,913 | A | 3/1910 | Hartzell | |
| 956,396 | A | 4/1910 | Mills et al. | |
| 956,657 | A | 5/1910 | Wetteroth | |
| 957,528 | A | 5/1910 | Wetteroth | |
| D45,227 | S | 2/1914 | Glauber | |
| 1,136,887 | A | 4/1915 | Penn | |
| 1,235,296 | A | 7/1917 | Dillingham | |
| 1,243,594 | A | 10/1917 | Dillingham | |
| 1,255,627 | A | 2/1918 | Morrow et al. | |
| 1,268,354 | A | 6/1918 | Howard | |
| 1,535,993 | A * | 4/1925 | Garfinkel | 135/29 |
| D90,772 | S | 9/1933 | Kasch | |
| D127,735 | S | 6/1941 | Dreyfuss | |

(Continued)

FOREIGN PATENT DOCUMENTS

| | | |
|---|---|---|
| CN | 2356535 | 1/2000 |
| CN | 2850373 | 12/2006 |

(Continued)

OTHER PUBLICATIONS

Operation Manual Easy Sun Parasol Sunshade (Issue: Jul. 2004) pp. 1-17.

(Continued)

*Primary Examiner* — Noah Chandler Hawk
(74) *Attorney, Agent, or Firm* — Knobbe Martens Olson & Bear LLP

(57) ABSTRACT

A rib connector is provided that has a first arm, a second arm, and a transverse member. The first arm has an inner wall, a first recess in the inner wall, and an inclined surface that extends toward the first recess. The second arm has an inner wall and a second recess. The second recess is positioned opposite to the first recess. The transverse member is located between the first arm and the second arm. The transverse member connects the first arm and the second arm. The transverse member is disposed adjacent to a space located between the first and second arms. The space is configured to receive an umbrella rib. A varying distance is provided between the inclined surface and the inner wall of the second arm such that the distance is less at a first position along the inclined surface than at a second position along the inclined surface. The first position is between the first recess and the second position.

24 Claims, 8 Drawing Sheets

(56) References Cited

U.S. PATENT DOCUMENTS

| | | | | |
|---|---|---|---|---|
| 2,447,972 | A | 8/1948 | Weinert | |
| 2,475,406 | A | 7/1949 | Russell | |
| D162,678 | S | 3/1951 | Muller-Munk | |
| D167,619 | S | 9/1952 | Coran | |
| 2,762,383 | A | 9/1956 | Wittman | |
| 2,937,653 | A | 5/1960 | Danciart et al. | |
| D190,597 | S | 6/1961 | Nelson | |
| 3,120,238 | A | 2/1964 | Glatz | |
| 3,145,720 | A | 8/1964 | Torii | |
| 3,177,882 | A * | 4/1965 | Militano | 135/28 |
| 3,340,352 | A | 9/1967 | Wladimiro et al. | |
| 3,424,180 | A * | 1/1969 | Andolfi | 135/28 |
| D230,115 | S | 1/1974 | Beams | |
| 3,856,032 | A | 12/1974 | Schafer | |
| 4,201,237 | A * | 5/1980 | Watts et al. | 135/98 |
| D265,498 | S | 7/1982 | Paul | |
| 4,368,749 | A * | 1/1983 | Lindler et al. | 135/15.1 |
| D276,838 | S | 12/1984 | Hill et al. | |
| D277,934 | S | 3/1985 | Beckrot | |
| 4,586,525 | A | 5/1986 | Glatz et al. | |
| D284,920 | S | 8/1986 | van Horn | |
| 4,622,987 | A | 11/1986 | Redl et al. | |
| 4,674,523 | A | 6/1987 | Glatz | |
| 4,811,670 | A | 3/1989 | Kolvites et al. | |
| 4,878,509 | A | 11/1989 | Tung | |
| 5,002,081 | A | 3/1991 | Stromeyer | |
| 5,029,596 | A | 7/1991 | Tung | |
| 5,050,627 | A | 9/1991 | Hengtzu | |
| 5,161,909 | A | 11/1992 | Crouse et al. | |
| D331,462 | S | 12/1992 | Kraus et al. | |
| 5,184,639 | A | 2/1993 | Lee | |
| 5,193,566 | A * | 3/1993 | Chen | 135/28 |
| 5,275,186 | A | 1/1994 | Liu | |
| D344,786 | S | 3/1994 | Short et al. | |
| 5,345,960 | A | 9/1994 | Tung | |
| 5,349,975 | A | 9/1994 | Valdner | |
| 5,357,994 | A | 10/1994 | Chung | |
| 5,433,233 | A * | 7/1995 | Shiran et al. | 135/20.1 |
| D362,833 | S | 10/1995 | McKelvey | |
| 5,499,644 | A | 3/1996 | Geniele | |
| D372,854 | S | 8/1996 | Jimenez | |
| 5,553,634 | A | 9/1996 | Yang | |
| 5,566,699 | A | 10/1996 | Kou | |
| 5,584,564 | A | 12/1996 | Phyle | |
| 5,588,455 | A | 12/1996 | Kuo | |
| 5,611,364 | A | 3/1997 | Woods et al. | |
| 5,655,557 | A | 8/1997 | Martin | |
| 5,715,853 | A | 2/1998 | Lin | |
| 5,740,823 | A | 4/1998 | Lin et al. | |
| 5,746,235 | A | 5/1998 | Lin | |
| 5,785,069 | A | 7/1998 | Glatz | |
| D397,054 | S | 8/1998 | Brantley et al. | |
| D398,443 | S | 9/1998 | Bolle | |
| 5,809,734 | A | 9/1998 | Turner | |
| D400,777 | S | 11/1998 | Carsello | |
| 5,884,645 | A | 3/1999 | Chen et al. | |
| D408,621 | S | 4/1999 | Kuo | |
| 5,899,210 | A | 5/1999 | Letherby et al. | |
| D410,862 | S | 6/1999 | Mihov | |
| 5,937,882 | A | 8/1999 | Harbaugh | |
| 5,964,235 | A | 10/1999 | Wang | |
| 6,014,980 | A | 1/2000 | Glatz | |
| D434,215 | S | 11/2000 | Lin | |
| D434,476 | S | 11/2000 | Meda | |
| 6,145,523 | A | 11/2000 | Lo | |
| 6,152,156 | A | 11/2000 | Tung | |
| D434,556 | S | 12/2000 | Lin | |
| 6,192,907 | B1 | 2/2001 | Wu | |
| 6,220,261 | B1 | 4/2001 | Glatz | |
| 6,230,728 | B1 | 5/2001 | Reese | |
| 6,247,483 | B1 | 6/2001 | Tung | |
| 6,305,394 | B1 | 10/2001 | Reese | |
| 6,311,705 | B1 | 11/2001 | Ma | |
| 6,311,707 | B1 | 11/2001 | Wu et al. | |
| 6,314,976 | B1 | 11/2001 | Clarke | |
| 6,371,141 | B1 | 4/2002 | Lin et al. | |
| 6,371,686 | B1 | 4/2002 | Wu | |
| 6,386,214 | B1 * | 5/2002 | Clarke | 135/20.3 |
| 6,386,215 | B1 | 5/2002 | Chang | |
| 6,412,506 | B1 | 7/2002 | Reese | |
| 6,422,251 | B1 | 7/2002 | Tseng | |
| D465,915 | S | 11/2002 | Earnshaw | |
| 6,478,037 | B2 | 11/2002 | Tung | |
| 6,571,813 | B2 | 6/2003 | Lin et al. | |
| 6,575,182 | B2 | 6/2003 | Tung | |
| 6,575,183 | B2 | 6/2003 | Tung | |
| D477,458 | S | 7/2003 | Goldwitz | |
| 6,588,438 | B1 | 7/2003 | Steiner | |
| D478,416 | S | 8/2003 | Clarke | |
| D479,797 | S | 9/2003 | Wall | |
| 6,619,306 | B2 | 9/2003 | Ma | |
| 6,662,815 | B2 | 12/2003 | Tung | |
| 6,732,753 | B2 | 5/2004 | Chang | |
| 6,758,229 | B2 | 7/2004 | Wang | |
| D497,478 | S | 10/2004 | Clarke | |
| D497,479 | S | 10/2004 | Yu | |
| 6,837,255 | B2 | 1/2005 | Bunch et al. | |
| 6,851,823 | B2 | 2/2005 | Bilotti | |
| D503,035 | S | 3/2005 | Ko | |
| 6,889,699 | B2 | 5/2005 | Clarke | |
| 6,920,887 | B2 * | 7/2005 | Lo | 135/32 |
| 6,941,960 | B2 | 9/2005 | Huang | |
| 7,000,624 | B2 | 2/2006 | Chang | |
| 7,040,587 | B2 | 5/2006 | Thompson et al. | |
| D525,721 | S | 7/2006 | Landes | |
| 7,082,953 | B2 | 8/2006 | Liu | |
| 7,089,950 | B2 | 8/2006 | Lin et al. | |
| D539,632 | S | 4/2007 | Ma | |
| D549,557 | S | 8/2007 | Mori et al. | |
| 7,293,573 | B2 | 11/2007 | Clarke | |
| D558,444 | S | 1/2008 | Ma | |
| 7,318,444 | B2 | 1/2008 | Clakre | |
| 7,328,715 | B2 | 2/2008 | Neubardt | |
| D563,780 | S | 3/2008 | Pitcher | |
| D565,944 | S | 4/2008 | Pitcher | |
| D575,143 | S | 8/2008 | Kuo et al. | |
| D593,653 | S | 6/2009 | Mitrani | |
| 7,546,845 | B2 | 6/2009 | Prusmack | |
| D596,482 | S | 7/2009 | Marinucci | |
| 7,614,413 | B1 * | 11/2009 | Ma | 135/32 |
| D606,379 | S | 12/2009 | Hughes | |
| 7,665,477 | B1 | 2/2010 | Hathaway | |
| 7,686,024 | B1 | 3/2010 | Lai | |
| 7,703,464 | B2 | 4/2010 | Ma | |
| D626,324 | S | 11/2010 | Ma | |
| D631,243 | S | 1/2011 | Forthuber et al. | |
| 7,861,734 | B2 | 1/2011 | Ma | |
| 7,891,367 | B2 | 2/2011 | Ma | |
| 7,900,643 | B2 | 3/2011 | Ma | |
| 7,913,708 | B2 | 3/2011 | Yung | |
| 8,061,375 | B2 | 11/2011 | Ma | |
| 8,082,935 | B2 | 12/2011 | Ma | |
| 8,096,310 | B2 | 1/2012 | Clarke | |
| 8,136,541 | B2 | 3/2012 | Beaulieu | |
| D658,977 | S | 5/2012 | Riddell et al. | |
| D679,581 | S | 4/2013 | Liu et al. | |
| 8,443,819 | B2 | 5/2013 | Beaulieu | |
| D696,104 | S | 12/2013 | Kampl | |
| D719,342 | S | 12/2014 | Ma | |
| D731,166 | S | 6/2015 | Ma | |
| 2002/0083969 | A1 | 7/2002 | Tung | |
| 2002/0129843 | A1 | 9/2002 | Wang | |
| 2002/0139405 | A1 | 10/2002 | Lee | |
| 2003/0015230 | A1 | 1/2003 | Glatz | |
| 2004/0031513 | A1 | 2/2004 | Bunch et al. | |
| 2004/0055627 | A1 | 3/2004 | Moga | |
| 2004/0055628 | A1 | 3/2004 | Yu | |
| 2004/0069333 | A1 | 4/2004 | Ma | |
| 2004/0154525 | A1 | 8/2004 | Wirth et al. | |
| 2004/0182429 | A1 | 9/2004 | Chen | |
| 2004/0206382 | A1 | 10/2004 | Clarke | |
| 2004/0206383 | A1 | 10/2004 | Clarke | |
| 2005/0098200 | A1 | 5/2005 | Su | |
| 2006/0005867 | A1 | 1/2006 | Chang | |

(56) References Cited

U.S. PATENT DOCUMENTS

| | | | | |
|---|---|---|---|---|
| 2006/0151019 | A1 | 7/2006 | Lo | |
| 2007/0034242 | A1* | 2/2007 | Chuang | 135/30 |
| 2007/0209691 | A1* | 9/2007 | Lin | 135/32 |
| 2008/0202570 | A1 | 8/2008 | Clarke | |
| 2010/0139724 | A1 | 6/2010 | Lai | |
| 2010/0139725 | A1 | 6/2010 | Lai | |
| 2010/0288318 | A1* | 11/2010 | Beaulieu | 135/29 |
| 2011/0061694 | A1 | 3/2011 | Vanderminden, Sr. | |
| 2011/0132418 | A1 | 6/2011 | Ma | |
| 2011/0209732 | A1 | 9/2011 | Ma | |
| 2011/0214705 | A1 | 9/2011 | Ma | |
| 2011/0277800 | A1 | 11/2011 | Tung | |

FOREIGN PATENT DOCUMENTS

| | | | |
|---|---|---|---|
| CN | 2896981 | | 5/2007 |
| CN | 202190859 | | 4/2012 |
| CN | 201130499431.4 | | 7/2012 |
| CN | 201230011965.2 | | 7/2012 |
| CN | 201230011967.1 | | 7/2012 |
| DE | 3820573 | | 8/1989 |
| DE | 202013100813 | | 5/2013 |
| FR | 2672781 | A3 | 8/1992 |
| JP | 2006-110317 | A | 4/2006 |
| JP | 2007-222591 | | 9/2007 |
| JP | 2008-142310 | | 6/2008 |
| WO | WO 2005/058089 | | 6/2005 |
| WO | WO 2013/104266 | | 7/2013 |

OTHER PUBLICATIONS

Treasure Garden, Inc., Collections 2012, Product Catalog, pp. 18-19 with front and rear covers.
Activa Leisure, 2010 Product Catalog.
Treasure Garden, Inc., Collections 2015, Product Catalog, including front and rear covers.

* cited by examiner

UMBRELLA RIB CONNECTOR

BACKGROUND OF THE INVENTION

1. Field of the Invention

This application is directed to connecting devices for components of shelters, including shade structures, pavilions, and umbrellas, which connecting devices are used to connect multiple ribs together, e.g., to connect a short rib and a long rib.

2. Description of the Related Art

A middle disk connecting the long and short umbrella ribs of sunshades available in the current market is fixed at the top of the long umbrella rib. An umbrella pin of the short umbrella rib is installed at the other end of the middle disk. For example Chinese utility model CN99252597.7 describes the use of a rivet to secure the short umbrella rib to a middle disk. In this design, the two ends of the rivet are exposed. Sunshades are usually used outdoors and the exposed rivet will corrode with extended use. The use of these rivets also makes the assembly process more complex and mars the appearance of the sunshade.

SUMMARY OF THE INVENTION

Therefore, an umbrella connecting device that is easy to assemble, stable in positioning, wind resistant, pleasing in appearance, economical and practical, is desired to solve problems and shortcomings, including those mentioned above.

An objective of this application is to address the shortcomings of prior technology by providing new umbrella connecting devices. The umbrella connecting devices are cleverly and uniquely designed, structurally simple, easy to assemble, stable in positioning, wind resistant, pleasing in appearance, economical and practical, and/or suitable for large-scale application.

This application discloses new umbrella connecting devices. In various embodiments, the connecting devices include a first clamping arm, a second clamping arm, a connecting portion and fasteners. The connecting device can be configured to achieve the aforementioned objectives. The first clamping arm is positioned opposite to the second clamping arm. The connecting portion is located between the first clamping arm and the second clamping arm. The connecting portion separates the space between the first clamping arm and the second clamping arm into two parts. The fastener passes through the connecting portion. The inner wall of each of the first clamping arm and the second clamping arm is equipped with an accommodating portion at or on an inner wall thereof. The accommodating portion of the first clamping arm can receive an end of a first umbrella pin. The accommodating portion of the second clamping arm can receive an end of a second umbrella pin. The accommodating portions can be disposed at the ends of the first and second umbrella pins. The accommodating portion at the end of the first umbrella pin is positioned opposite to the accommodating portion at the end of the second umbrella pin. The accommodating portions can be disposed at first and second ends of a single pin that extends entirely through an umbrella rib as discussed below. The inner wall of the first clamping arm also can have an inclined surface that extends from the accommodating portion of the first clamping arm. The inclined surface can be tilted towards the inner wall of the second clamping arm. In one embodiment, the inclined surface extends from an outer edge of the inner wall of the first clamping arm to the accommodating portion.

In some embodiments, the inner wall of the first clamping arm is equipped with a groove. The opening of the groove can face the inner wall of the second clamping arm. The inclined surface is or comprises a portion of the bottom surface of the groove in some embodiments.

In some embodiments, the inclined surface intersects with the two side walls of the groove at an angle of inclination.

The accommodating portion disposed on the first and/or the second clamping arms can comprise a concave recess or a concave hole, which can be configured to receive the end of an umbrella pin, e.g., an end of a first umbrella pin and an end of a second umbrella pin or opposite ends of a single umbrella pin.

In some embodiments, the fastener(s) is/are a blind rivet. Some assemblies provide two fasteners. The fasteners can be spaced apart in the direction parallel to the first clamping arm, the second clamping arm, or the first and second clamping arms.

The first clamping arm, the second clamping arm and the connecting portion preferably are formed integrally into one unit.

Advantages of the constructions described herein are many. For example, the umbrella connecting devices of this application comprise a first clamping arm, second clamping arm, connecting portion and fasteners. The first clamping arm is positioned opposite to the second clamping arm. The connecting portion is located between the first clamping arm and the second clamping arm. The connecting portion connects the first clamping arm and the second clamping arm. The connecting portion separates a space between the first clamping arm and the second clamping arm into two parts. A first part receives a portion of a long umbrella rib (e.g., the ribs that are directly below the generally fabric canopy) and a second part receives a portion of a short rib of an umbrella assembly (e.g., struts extending between a runner and the upper ribs). The fastener passes through the connecting portion. The inner wall of the first clamping arm can be equipped with an accommodating portion. The inner wall of the second clamping arm can be equipped with an accommodating portion. The accommodating portion of the first clamping arm can be a first accommodating portion and the accommodating portion of the second clamping arm can be a second accommodating portion. The accommodating portion of the first clamping arm can receive an end of a first umbrella pin and the accommodating portion of the second clamping arm can receive an end of a second umbrella pin. The accommodating portion configured to receive the end of the first umbrella pin is positioned opposite to the accommodating portion configured to receive the end of the second umbrella pin.

The inner wall of the first clamping arm also can have an inclined surface that extends from the outer edge of the inner wall of the first clamping arm to the accommodating portion. The inclined surface can be tilted towards the inner wall of the second clamping arm. One end of an umbrella pin coupled with a short umbrella rib can easily engage one of the accommodating portions of the second clamping arm and another end of the umbrella pin can be passed along the inclined surface disposed on the first clamping arm. The long umbrella rib is installed at the second part and is securely fixed using fasteners.

The connecting device is cleverly and uniquely designed, structurally simple, easy to assemble, stable in positioning, wind resistant, pleasing in appearance, economical and practical, and it is suitable for large-scale application.

This application involves an umbrella connecting device comprising a first clamping arm, second clamping arm, connecting portion and fasteners. The first clamping arm is positioned opposite the second clamping arm. The connecting portion is located between the first clamping arm and second clamping arm, and connects the first clamping arm and the second clamping arm. The connection portion separates the space between the first clamping arm and the second clamping arm into two parts. The fastener(s) pass through the connecting portion. The inner wall of the first clamping arm is equipped with an accommodating portion. The second clamping arm is also equipped with an accommodating portion. The accommodating portions are disposed at the end of an umbrella pin. In one embodiment, the accommodating portion on the inner wall of the first clamping arm is disposed at an end of a first umbrella pin. The accommodating portion on the inner wall of the second clamping arm is disposed at an end of a second umbrella pin. The accommodating portion disposed on the first clamping arm is positioned opposite to the accommodating portion disposed on the second clamping arm. The accommodating portion at the end of the first umbrella pin is positioned opposite to the accommodating portion at the end of the second umbrella pin. The inner wall of the first clamping arm also has an inclined surface that extends from the accommodating portion disposed on the first clamping arm toward an edge thereof. In one embodiment, the inclined surface extends from the outer edge of the inner wall of the first clamping arm to the accommodating portion at the end of the first umbrella pin. The inclined surface can be tilted towards the inner wall of the second clamping arm.

In another embodiment, an umbrella connecting device is provided that includes a first clamping arm, a second clamping arm, and a connecting portion. The second clamping arm is positioned opposite to the first clamping arm. The connecting portion is located between the first clamping arm and the second clamping arm. The connecting portion connects the first clamping arm and the second clamping arm. A space can be provided between the first clamping arm and the second clamping arm. The connecting portion can separate the space between the first clamping arm and the second clamping arm into two portions. The umbrella connecting device also includes a plurality of fasteners configured to be advanced through apertures in the connecting portion. The inner wall of the first clamping arm has a first accommodating portion. The inner wall of the second clamping arm has a second accommodating portion. The second accommodating portion is positioned opposite to the first accommodating portion. The inner wall of the first clamping arm includes an inclined surface that extends from an outer edge of the inner wall of the first clamping arm to the first accommodating portion. The inclined surface can be tilted toward the inner wall of the second clamping arm.

In another embodiment, a rib connector is provided that has a first arm, a second arm, and a transverse member. The first arm has an inner wall, a first recess in the inner wall, and an inclined surface that extends toward the first recess. The second arm has an inner wall and a second recess. The second recess is positioned opposite to the first recess. The transverse member is located between the first arm and the second arm. The transverse member connects the first arm and the second arm. The transverse member is disposed adjacent to a space located between the first and second arms. The space is configured to receive an umbrella rib. A varying distance is provided between the inclined surface and the inner wall of the second arm such that the distance is less at a first position along the inclined surface than at a second position along the inclined surface. The first position is between the first recess and the second position.

In another embodiment, an umbrella connecting device is provided that includes a rib and a connector. The rib has a transverse member that has a length and an elongate body from which the transverse member extends. The connector includes a first arm, a second arm, and a connecting portion. The first arm has an inner wall having a first accommodating portion, e.g., a recess, formed therein. The second arm is positioned opposite to the first arm. The second arm has an inner wall that has a second accommodating portion, e.g., a recess. The connecting portion is located between the first arm and the second arm. The connecting portion connects the first arm and the second arm. In the connector, a space is provided between the first and second arms. The space has a width measured transverse to the inner walls of the first and second arms. The width is less than the length of the transverse member of the rib. The connector is configured such that upon advancement of the transverse member of the rib into engagement with inner portions of the arms, the arms are deflected away from each other. The deflection permits further advancement of the transverse member to the accommodating portions of the first and second arms.

In another embodiment, a method of assembly of an umbrella portion is provided. In the method, a first rib is coupled with a connector such that the first rib and connector are not movable relative to each other. A second rib is advanced into an open channel of the connector. The open channel enlarges in a direction transverse to the direction of advancing of the second rib during advancing of the second rib. After advancing, the second rib is pivotable in the second open channel.

BRIEF DESCRIPTION OF THE DRAWINGS

These and other features, aspects and advantages are described below with reference to the drawings, which are intended to illustrate but not to limit the inventions. In the drawings, like reference characters denote corresponding features consistently throughout similar embodiments.

DETAILED DESCRIPTION OF EMBODIMENTS

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present inventions provided that the features included in such a combination are not mutually inconsistent.

Figure 1:
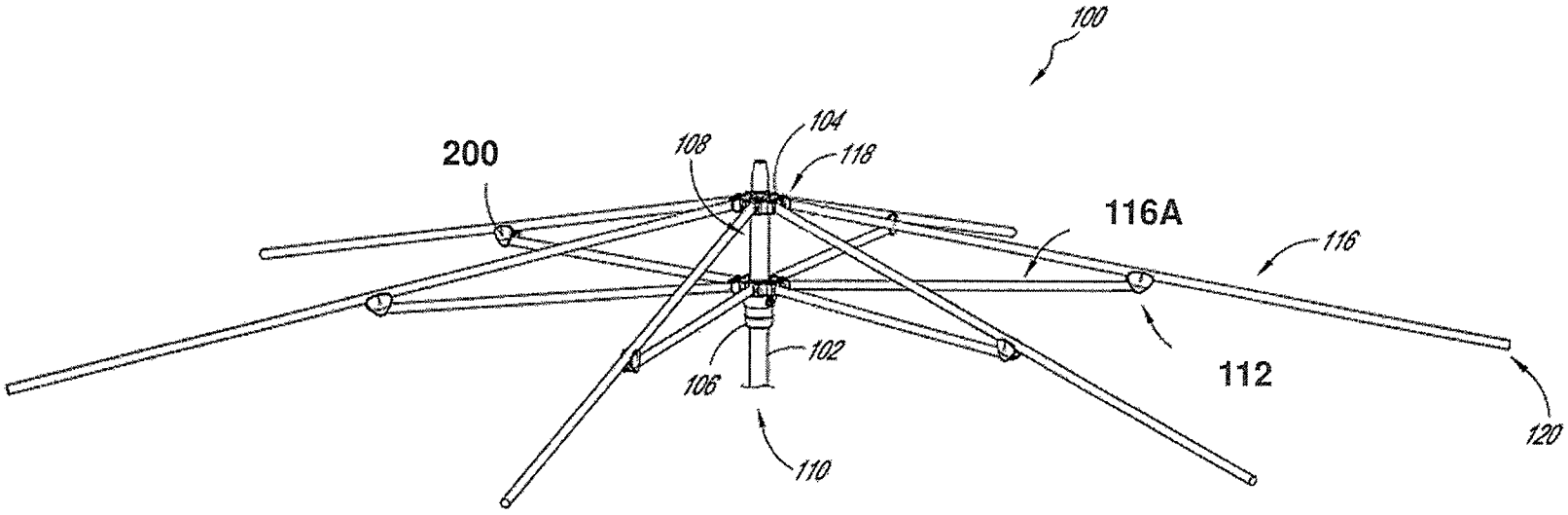
FIG. 1 is a side perspective view of an umbrella frame and pole assembly for an umbrella.

FIG. 1 illustrates an embodiment of an umbrella or umbrella assembly 100. The umbrella assembly 100 can comprise a pole 102, an upper hub 104, and a lower hub or runner 106. The pole 102 can comprise an upper end 108 and a lower end 110. The upper hub 104 can be configured to be coupled with the upper end 108 of the pole 102. The runner 106 can be disposed beneath the upper hub 104 and configured to be coupled with the pole 102 to slide between a lower position in which the umbrella assembly 100 is closed (not shown) and an upper position in which the umbrella assembly 100 is open, as in FIG. 1. As illustrated in FIGS. 2-8, in some embodiments, a connecting device 112 is disposed between main and supporting ribs 116, 116A of the umbrella assembly. In some embodiments, the ribs 116 (sometimes referred to herein as long umbrella ribs) can each have a first end 118 and a second end 120. The ribs 116A (sometimes referred to herein as short umbrella ribs or struts) connect to the ribs 116 between the ends 118, 120.

Figure 3:
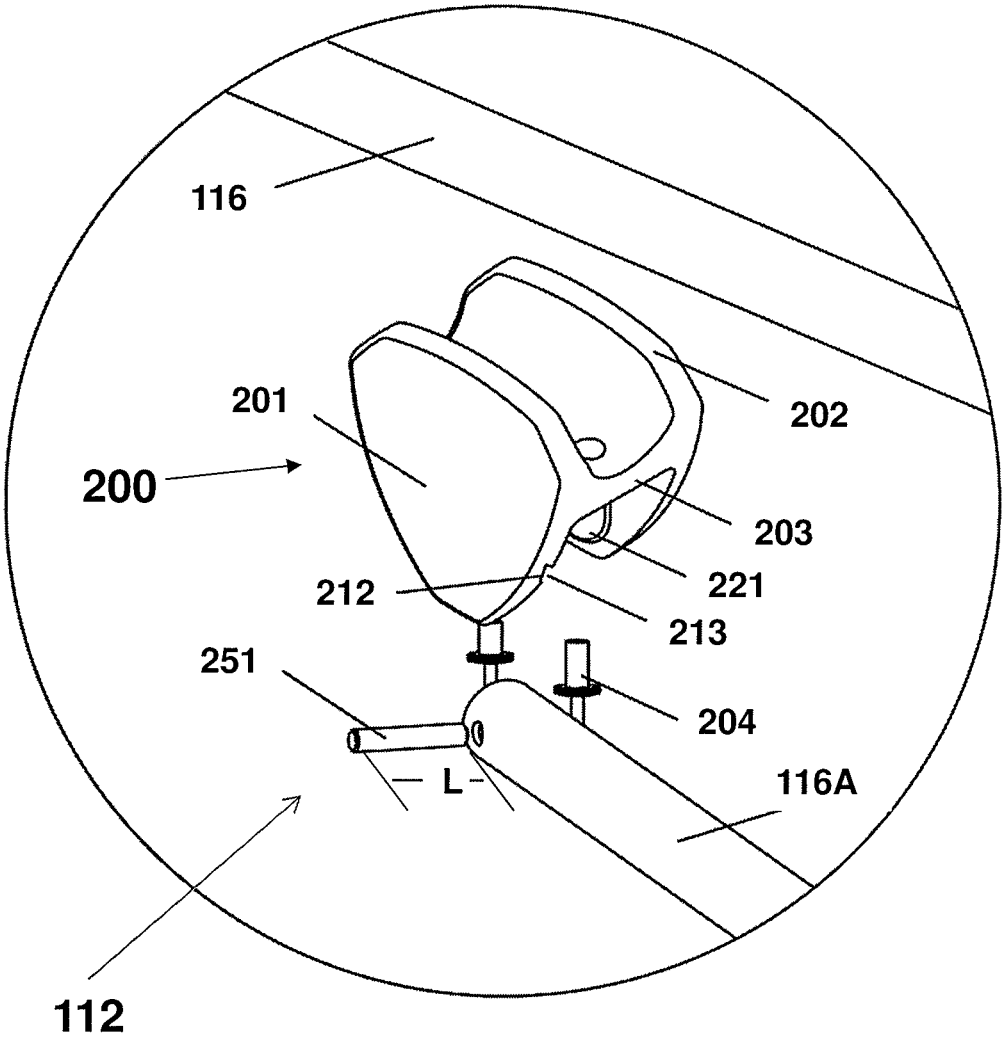
FIG. 3 is an exploded view of the umbrella frame portion of FIG. 2.
Figure 4:
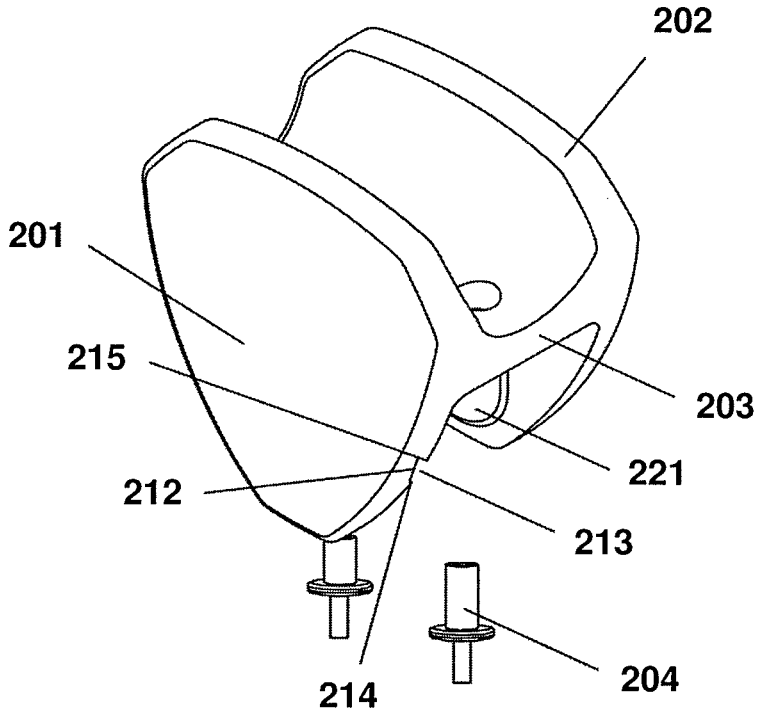
FIG. 4 is an exploded view of an umbrella connector used in the umbrella frame portion of FIG. 2.
Figure 5:
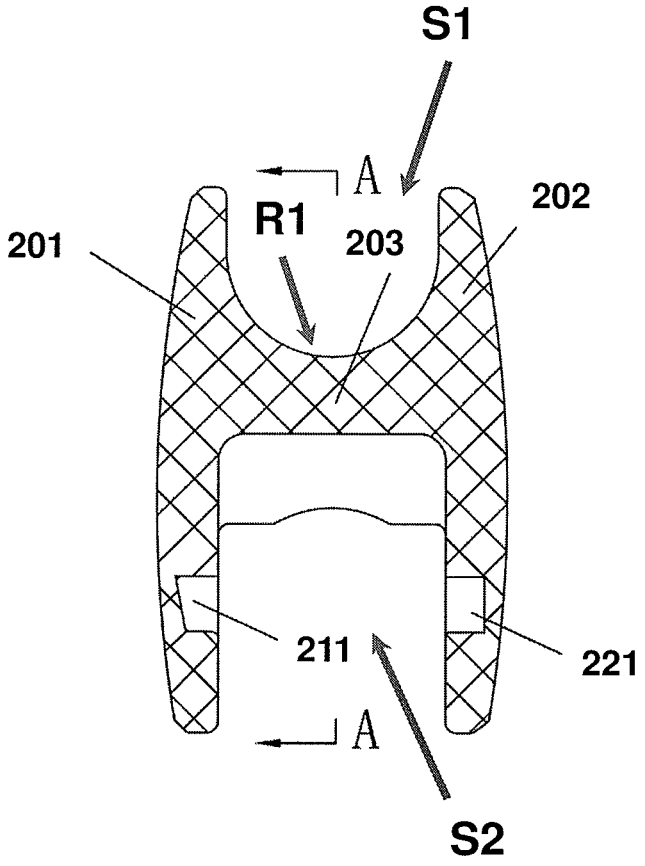
FIG. 5 is a cross-sectional view of a portion of the umbrella connector of FIG. 4.

With reference to FIGS. 2 to 7, the umbrella connecting device 112 comprises a connector 200 and a fastener 204. The connector 200 has a first clamping arm 201, a second clamping arm 202, and a connecting portion 203. The first clamping arm 201 is positioned opposite to the second clamping arm 202. The connecting portion 203 extends transversely to and is located between the first clamping arm 201 and the second clamping arm 202 and connects the first clamping arm 201 and the second clamping arm 202. The connecting portion 203 separates the space between the first clamping arm 201 and the second clamping arm 202 into two parts or spaces S1 and S2. The space S1 is shown in FIG. 5 to be generally above and the space S2 to be generally below the connecting portion 203. The space S1 is open at the top such that a rib 116 can be easily slide into the space and received on a curved rib receiving surface R1. The space S2 is open at the bottom such that a rib 116A can be received therein and can pivot through the space S2 including through the open bottom.

As will be understood from the discussion herein, by providing the open spaces S1, S2, the connector 200 can be quickly coupled with the ribs 116, 116A to provide rapid assembly of an umbrella portion. The assembly does not require that the connector 200 be altered to engage the ribs 116, 116A other than upon insertion as discussed below. Prior art connectors may require the user to fold or compress connector portions onto rib portions, which is time consuming. Also, by configuring the connector 200 to be open on its top and bottom portions, each rib 116, 116A can be inserted to be received against or adjacent to the connection portion 203. Also, the connector 200 allows the first space S1 to be accessed without requiring any deformation of the connector.

The structures around the second space S2 can be configured to undergo a stretching or an enlargement during a convenient assembly technique. For example, a rigid member coupled with a rib 116A can be advanced to be disposed at least partially between the inner walls of the clamping arms 201, 202. Such rigid member can induce the stretching or enlargement in some embodiments. For example, in one embodiment the inner walls on opposite sides of the space S2 are spaced apart by an amount that is less than the length of a pin which is used to join a rib 116A to the connector 200. The separation of the walls around the space S2 is large enough that the rib 116A can swing between the walls with little or no contact with the walls. The pin is long enough to span a gap between the ribs 116A and adjacent walls and to be disposed within the thickness of the wall.

The inner walls on opposite sides of the space S1 preferably are spaced apart by an amount sufficient to permit a rib 116 to be received therein without any deforming force being applied to push these lateral walls away from each other. These features optimize the assembly process to permit a combination of fixed connection between the rib 116 and the connector in the space S1 and pivoting connection between the rib 116A and the connector 200. Of course, the connecting device 112 could also be used in a shelter structure to connect two ribs that need not pivot, e.g., a structure that is not foldable or collapsible but perhaps is disassembled from time to time.

Figure 6:
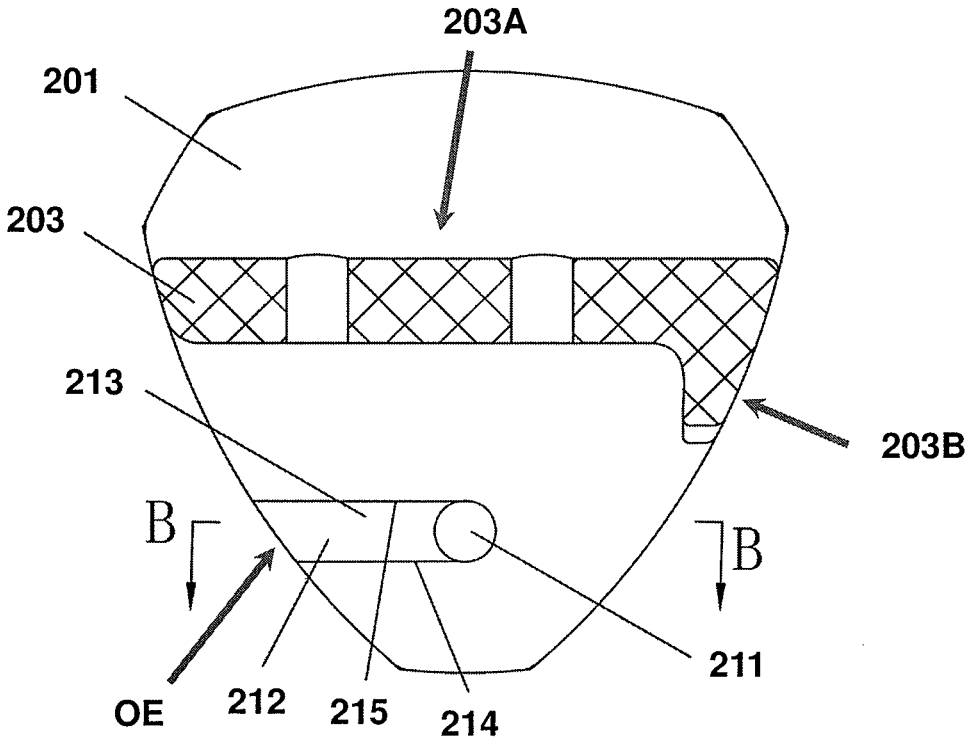
FIG. 6 is a cross-sectional view of the umbrella connector portion of FIG. 5 taken at A-A.

FIG. 6 shows that the connecting portion 203 has a first segment 203A that extends along the width of the connector 200. As used herein, the width is the left-right dimension in the FIG. 6 view. The connecting portion has a second segment 203B at one end of the first segment 203A. The second segment 203B extends generally transverse to the first segment 203A. The second segment 203B extends downwardly into the space S2 in one embodiment. As discussed further below, the first and second clamping arms 201, 202 are configured to flex away from each other to some extent during assembly of the umbrella assembly of FIG. 2. In certain embodiments, the second segment 203B strengthens a lateral portion of the connector 200 where such flexing is less important or not needed. Indeed, the second segment 203B provides enhanced strength to the connector 200 such that once a transverse member, e.g., a pin 251 of a rib 116A is inserted into the connector upon assembly (as discussed below) the pin will not inadvertently be dislodged due to unwanted in-use flexing of the arms 201, 202. Because the second segment 203B is to be opposite the assembly side of the connector (which is the left side in FIG. 6), the second segment will be outwardly facing (e.g., facing away from a center pole if provided) in the umbrella assembly of FIG. 2. The fastener 204 passes through the connecting portion 203, in the assembly of FIG. 2. FIG. 6 shows two passages through the connecting portion 203 through which the fasteners 204 can be advanced, one through each passage.

FIGS. 5 and 6 show that the inner wall of the first clamping arm 201 can be equipped with an accommodating portion 211. The accommodating portion 211 is configured to receive an end of an umbrella pin 251 (shown in FIG. 3). The end of the pin can be an end of a first of two umbrella pins or an end of a single umbrella pin, as in FIG. 3. FIG. 5 shows that the inner wall of the second clamping arm 202 also can be equipped with an accommodating portion 221, which is disposed at the end of the umbrella pin 251 or at the end of a second umbrella pin if more than one pin is provided. The accommodating portion 211 is positioned opposite to the accommodating portion 221. More specifically, an axis extending normal to a central zone of the accommodating portion 211 will also intersect the accommodating portion 221.

Figure 7:
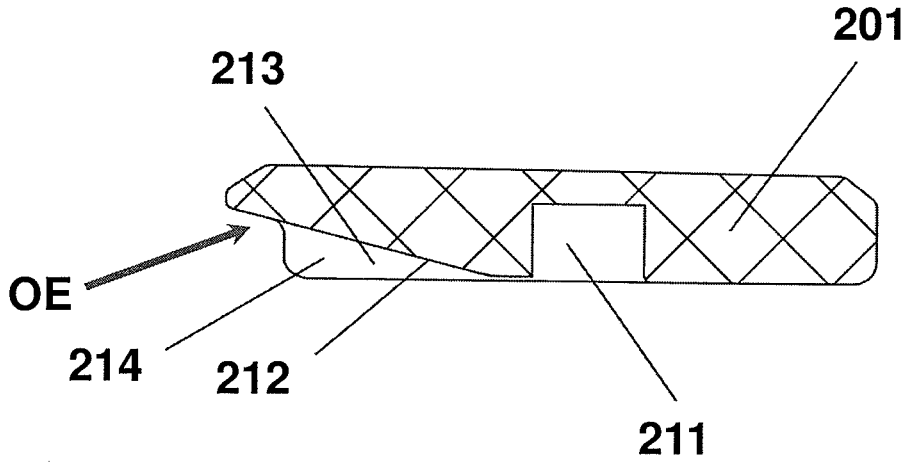
FIG. 7 is a cross-sectional view of the umbrella connector portion of FIG. 5 taken at B-B in FIG. 6.

FIGS. 6 and 7 also show that the inner wall of the first clamping arm 201 also has an inclined surface 212 in some embodiments. The inclined surface 212 extends from an outer edge OE of the inner wall of the first clamping arm 201 to the accommodating portion 211. The inclined surface 212 can be placed at any suitable location, e.g., extending from other edges of one or both of the first and second clamping arms to a corresponding (or both) accommodating portion 211, 221. The outer edge OE can be a lateral edge as shown in FIG. 6. As discussed above, the outer edge OE preferably is disposed on a side of the connector 200 that would face toward a central portion of an umbrella into which the connector 200 is provide. The advantage of this arrangement is that larger loads are applied to the right-hand side of the accommodating portion 211 as viewed in FIG. 7 than to the left hand side. More generally larger loads are applied to the side of the accommodating portion closer to the second segment 203B of the connecting portion 203 than are applied to the side away from the second segment 203B. Thus, the portion of the connector 200 that is subject to the largest loads is reinforced by the second segment 203B to reduce the risk of inadvertent dislodgement. In some cases, the inclined surface 212 is disposed along a direction generally away from the direction along which the rib 116A extends in use. For example, if the umbrella 100 is constructed such that larger loads are applied toward the central region of the umbrella canopy, the opposite arrangement may be more advantageous.

The inclined surface 212 can provide a path for the pin 251 to travel to the accommodating portion 211. The inclined surface 212 preferably is tilted towards the inner wall of the second clamping arm 202. For example, in various embodiments the inclined surface 212 is recessed into the inner wall of the first clamping arm 201 in the space S2. The inclined surface 212 can be recessed by an amount that varies along the length of the inclined surface. For example, the depth to which the inclined surface 212 is recessed can be greatest at or adjacent to the outer edges OE and can be lessened along a path from the outer edge to the accommodating portion. FIG. 7 shows one embodiment in which the inclined surface 212 generally continuously decreases in depth by an amount that is constant per unit length toward the accommodating portion 211. The inclined surface 212 can have a constant slope as shown. In one embodiment, the angle of the inclined surface 212 to the direction of travel of the pin 251 (from left to right in FIGS. 6 and 7) is less than about 60 degrees, for example about 45 degrees or less. In certain embodiments, the angle of the inclined surface is no more than 30 degrees, e.g., about 20 degrees or less. Embodiments in which the inclined surface 212 has a low angle are easier to assembly because they more gradually deflect the first and second clamping arms 201, 202 as the pin 251 travels along the surface as discussed elsewhere herein.

With reference to FIGS. 4, 6, and 7, in specific embodiments of this application, the inner wall of the first clamping arm 201 is equipped with a groove 213. The opening of the groove 213 faces the inner wall of the second clamping arm 202. The groove 213 is elongated and extends in a direction along the width of the connector 200. For example, the groove 213 can be at least as long as the transverse dimension of (e.g., diameter of) the pin 251. In some embodiments, the groove 213 extends by a dimension that is at least two times the diameter of the pin 251. In other embodiments, the groove 213 extends by a dimension that is at least about four times the diameter of the pin 251. In other embodiments, the groove 213 extends by a dimension that is about five times the diameter of the pin 251. In other embodiments, the groove 213 extends by a dimension that is about six times the diameter of the pin 251. By configuring the groove 213 to be elongate compared to the width of the pin 251, the assembly process is much more convenient than if the groove were short. For example, the inclined surface 212 is the bottom surface of the groove 213. By lengthening the groove 213, the inclined surface 212 can have a shallow slope. This eases sliding the pin 251 in the groove 213 and stretching or deflecting the first and second clamping arms 211, 212.

The inclined surface 212 may intersect vertically or at an angle of inclination with the two side walls 214 and 215 of the groove 213. With reference to FIGS. 4, 6 and 7, in various embodiments, the inclined surface 212 intersects with the two side walls 214 and 215 of the groove 213 at an angle of inclination. The angle of inclination can be any of those discussed above in connection with the direction of travel of the pin 251.

The accommodating portion 211 and the accommodating portion 221 can be of any suitable structure suitable to be disposed at the end of an umbrella pin. With reference to FIGS. 5 and 7, the accommodating portion 211 and the accommodating portion 221 include concave holes or recesses in various embodiments. These concave recesses are configured to receive ends of a pin or of first and second pins as discussed further below. For example, in one assembly, the pin 251 can be disposed through the rib 116A such that a length L of the pin projects laterally on both sides of a central longitudinal plane of the rib 116A. There is a close fit between the rib 116A and the space S2 of the connector. The close fit permits that rib 116A to swing within the space S2 but prevents the rib from being too loose between the inner walls of the first and second clamping arms 201, 202. The depth of each of the accommodating portions 211, 212 is slightly greater than the dimension L such that the ends of the pin 251 are substantially entirely received in the accommodating portions 211, 212. In variants, the accommodating portions have a depth that is greater than the dimension L such that some lateral play in the ribs 116A in the space S2 is permitted. This play allows the ribs 116A and the canopy to flex somewhat in the wind or under other loads.

The fastener 204 can be any suitable component. With reference to FIG. 4, in various embodiments, the fastener 204 is a rivet, e.g., a blind rivet. The quantity of the fastener 204 can be determined based on the size, weight, condition in which the umbrella is to be used or other needs. With reference to FIG. 4, two fasteners 204 can be provided and installed in the span of the connector 203 that extend in the direction parallel to the first clamping arm 201 and/or the second clamping arm 202.

With reference to FIGS. 4 to 5, in specific embodiments of this application, the first clamping arm 201, the second clamping arm 202 and the connecting portion 203 are formed integrally into one unit to enhance the strength of the connector 200. As discussed above, the second segment 203B of the connecting portion 203 is also configured to enhance the strength of the connector 200. The second segment 203B asymmetrically strengthens the connector 200 to optimize its ability to carry asymmetric loading form the ribs 116A.

Figure 2:
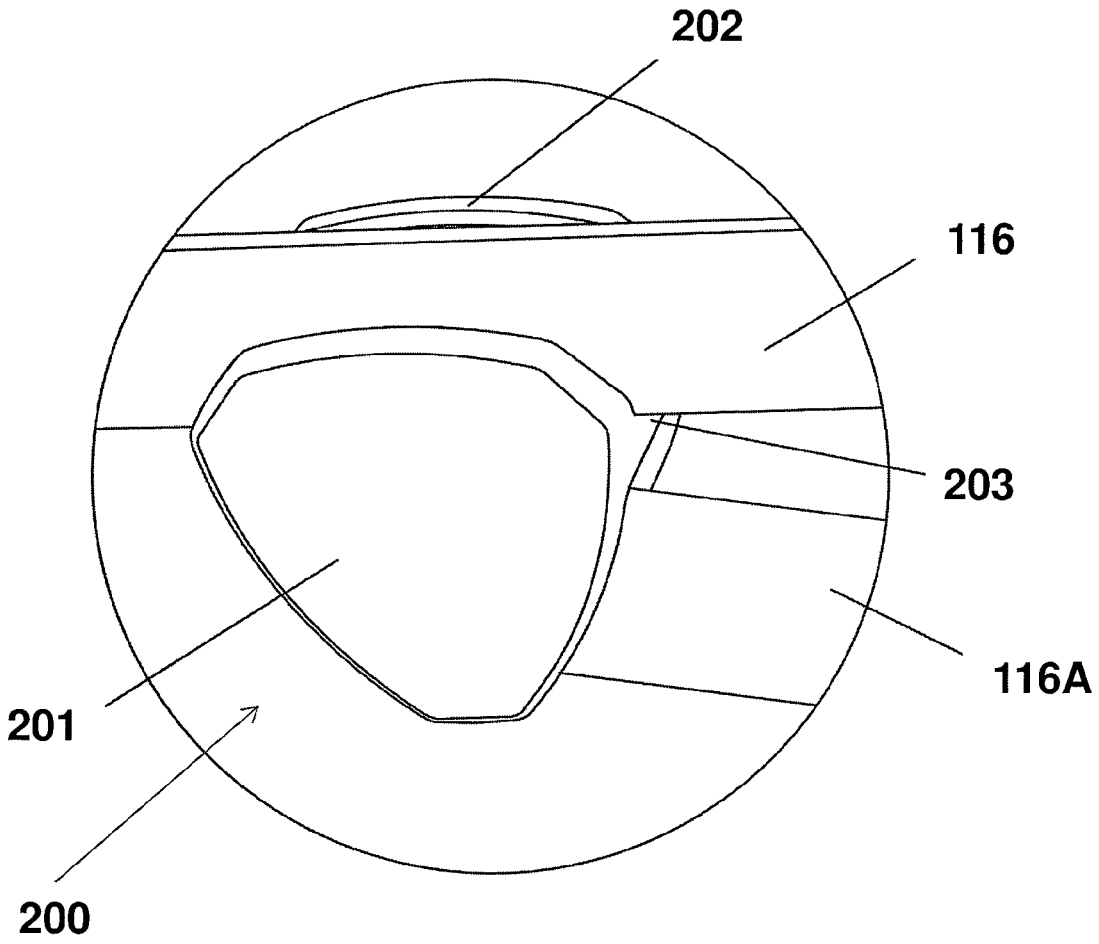
FIG. 2 is a side perspective view of a portion of an umbrella frame including a rib assembly.

When using certain embodiments of this application to form the assembly of FIG. 2, the ribs 116 can be placed in a space S1 at least partially surrounded by the first clamping arm 201, the second clamping arm 202 and the connecting portion 203. The space S1 is disposed above the connecting portion 203 as viewed in FIG. 5. The space S1 also is generally above the connecting portion 203 in the umbrella assembly of FIGS. 1-3. The surface R1 is shaped to receive the outer profile of the rib 116, e.g., may have a radius of curvature in cross-section (as in FIG. 5) that is about the same as or slightly larger than the radius of curvature of the rib 116. As discussed above, the arms 201, 202 preferably are configured to not require any displacement or deformation for the rib 116 to be disposed therebetween and in contact with the surface R1. With reference to FIG. 3, the fasteners 204 pass through connecting portion 203 and the rib 116 to secure the rib 116 to the connector 200.

Figure 8:
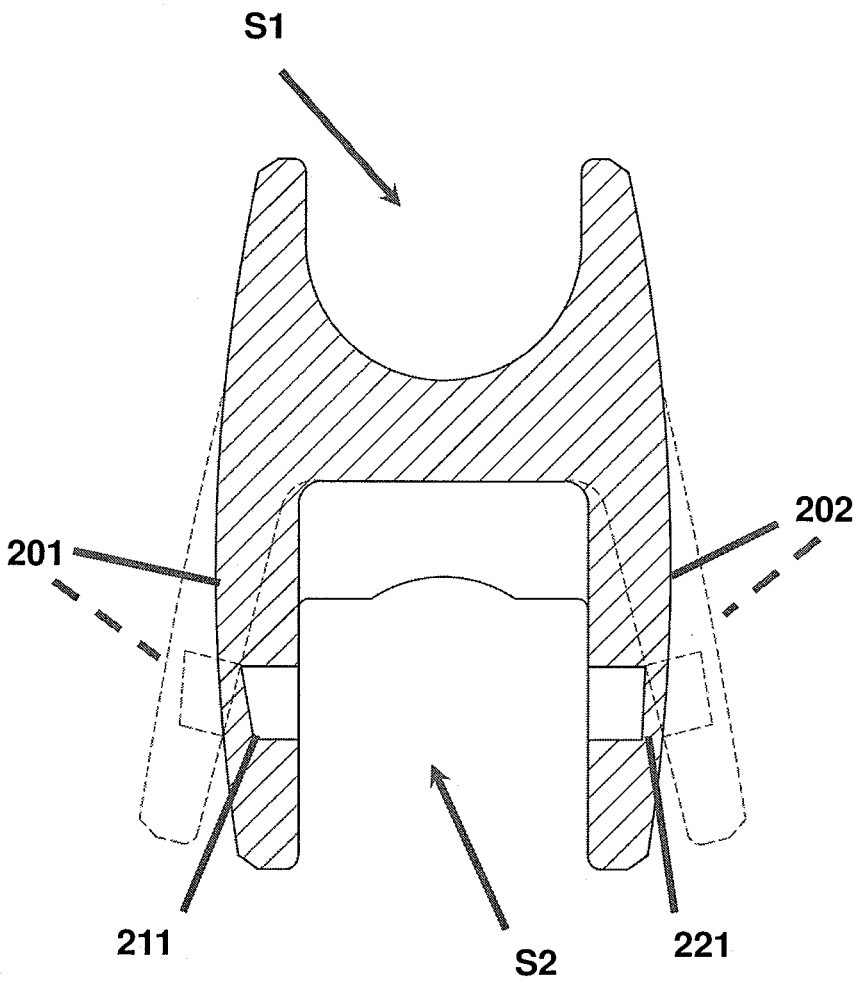
FIG. 8 is a view similar to FIG. 5 showing assembly of the umbrella frame portion of FIG. 2 using the umbrella connector illustrated therein.

To further assemble the umbrella assembly of FIG. 2, an umbrella pin 251 is installed in the rib 116A. As discussed above, the length L of the pin 251 is preferably greater than the at-rest separation between the walls of the clamping arms 201, 202 in the space S2. The umbrella pin 251 is caused to slide in the groove 213 to press against inclined surface 212. The connector 200 is configured such that when the umbrella pin 251 is moved in the groove 213 from the outside edge OE toward the accommodating portion 211, such movement causes the first clamping arm 201 and second clamping arm 202 to stretch open, e.g., to deflect away from each other. FIG. 8 illustrates this phase of assembly and this capability of the connector 200. In particular, the dashed line outline of the clamping arms 201, 202 shows that the arms 201, 202 may be moved away from each other as the pin 251 is advanced along the groove 213. Maximum lateral deflection may occur as the pin 251 approaches the accommodating portions 211, 221. In FIG. 6, this condition will be just to the left of the accommodating portion 211.

Although the arms 201, 202 are shown as generally symmetrically deflecting in various embodiments, the arms 201, 202 may deflect asymmetrically, e.g., the arm 201 may deflect more because of the location of the groove 213 on the arm 201.

After a first end of the umbrella pin 251 reaches the accommodating portion 211 and a second end of the umbrella pin reaches the accommodating portion 221, the first and second clamping arms 201, 202 return to their original condition. In various embodiments, the first and second clamping arms 201, 202 recover the strain energy stored in the connector 200 in moving back to their at-rest positions. The umbrella pin 251 is able to hang onto, e.g., is retained in, the accommodating portion 211 at a first end of the pin 251 and onto/in accommodating portion 221 at a second end of the pin. The assembly of the umbrella ribs is completed, as shown in FIG. 2. Because the clamping arms 201, 202 are configured to automatically return to their at-rest state when the pin 251 reaches the accommodating portions 211, 221 a superfluous step of closing a closure member or affixing various structures of the connector together after positioning of the pin is eliminated. This is an example of the ways in which the connector 200 can streamline assembly processes and allow the manufacture to deliver higher levels of performance for comparable or lower cost.

There are many advantages of the devices and assemblies herein. As the accommodating portion 211 at one end of the umbrella pin 251 and accommodating portion 221 at the other end of the umbrella pin and the fastener 204 is installed inside the umbrella connecting device, there are no grooves or holes on the outside surface of the connector 200. The umbrella pin 251 and the fasteners 204 are not exposed. Thus, these components are less susceptible to moisture and corrosion, and the umbrella is also pleasing in appearance. This allows the design to include dissimilar materials optimized for their application, for example forming the rib 116A of a polymeric material and the pin of a metal. The metal pin is much stronger and its enclosure within the connector reduces, minimizes or eliminates corrosion and other failure modes accelerated by greater exposure to the elements.

Also, the one way nature of the elongated inclined surface 212 help to assure that the rib 116A and the connector 200 will be easily assembled but will not become disassembled after completion of the assembly, e.g., after shipment to end users.

The umbrella connecting device of this application is cleverly and uniquely designed, structurally simple, easy to assemble, stable in positioning, wind resistant, pleasing in appearance, economical and practical, and it is suitable for large-scale application.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An umbrella connecting device, comprising:

a first arm comprising a first inner wall having a first lateral extent;

a second arm comprising a second inner wall positioned opposite to the first inner wall, the second arm having a second lateral extent;

a connecting portion located between the first inner wall and the second inner wall and connecting the first arm and the second arm, the connecting portion separating an upper rib space from a lower rib space;

at least one aperture extending through the connecting portion between the upper rib space and the lower rib space and within the first lateral extent of the first arm and within the second lateral extent of the second arm; and at least one fastener configured to be advanced through the at least one aperture in the connecting portion;

wherein the first inner wall includes a groove that extends from a location on a lateral edge of the first inner wall, the location being spaced away from the connecting portion, the groove extending toward a concave recess that is embedded in the first inner wall and that does not extend through to an outer side of the first inner wall.

2. The umbrella connecting device of claim 1, wherein the at least one fastener comprises at least one rivet.

3. The umbrella connecting device of claim 1, comprising two fasteners, the connecting portion including two apertures extending from the upper rib space to the lower rib space.

4. The umbrella connecting device of claim 1, wherein the first arm, the second arm and the connecting portion are integrally formed as one unit.

5. The umbrella connecting device of claim 1, wherein:

the first arm comprises an inclined surface that extends toward the concave recess;

the second arm comprises a second recess, the second recess being positioned opposite to the concave recess;

a U-shaped space disposed on a side of the connecting portion opposite the concave recess, the U-shaped space configured to receive an umbrella rib, the U-shaped space being bounded at one end by the connecting portion, on a first side by the first inner wall, and on a second side opposite the first side by the second inner wall and being open at first and second ends and along a portion disposed between the ends and opposite the connecting portion;

wherein a varying distance is provided between the inclined surface and the inner wall of the second arm such that the distance is less at a first position along the inclined surface than at a second position along the inclined surface, the first position being between the concave recess and the second arm.

6. The rib connector of claim 5, wherein the inclined surface is formed in a groove in the inner wall of the first arm.

7. The rib connector of claim 5, wherein the space is a first space and the first arm and the second arm extend to a location on a side of the connecting portion opposite the first space, the first and second arms further bounding a second space configured to receive an umbrella rib by sliding engagement with a rib end along the inclined surface.

8. The umbrella connecting device of claim 1, wherein the first inner wall comprises a first accommodating portion and the second inner wall comprises a second accommodating portion, the second accommodating portion being positioned opposite to the first accommodating portion.

9. The umbrella connecting device of claim 8, wherein the first inner wall further comprises an inclined surface that extends from an outer edge of the first inner wall of the first arm to the first accommodating portion.

10. The umbrella connecting device of claim 9, wherein the first inner wall comprises a groove and the opening of the groove faces the second inner wall, the inclined surface being disposed at the bottom surface of the groove.

11. The umbrella connecting device of claim 9, wherein the inclined surface intersects with the two side walls of the groove at an angle of inclination.

12. The umbrella connecting device of claim 8, wherein the first accommodating portion and the second accommodating portion each comprise a concave recess.

13. An umbrella connecting device, comprising:

a rib comprising a transverse member having a length and an elongate body from which the transverse member extends, the elongate body extending along a longitudinal axis, the longitudinal axis extending along the length of the rib;

a connector comprising:

a first arm comprising an inner wall having a first accommodating portion;

a second arm positioned opposite to the first arm, the second arm comprising an inner wall having a second accommodating portion;

a connecting portion located between the first arm and the second arm and connecting the first arm and the second arm;

a first rib space disposed between the first and second arms on a first side of the connecting portion; and a second rib space disposed between the first and second arms on a second side of the connecting portion opposite the first side, the second rib space having a width measured transverse to the inner walls of the first and second arms, the width being less than the length of the transverse member of the rib;

wherein the connector is configured such that upon advancement of the transverse member of the rib into engagement with inner portions of the arms in the second rib space, the arms are deflected away from each other to permit further advancement of the transverse member to the accommodating portions of the first and second arms; and wherein the connector is adapted such that the rib can be moved into the first rib space by relative motion transverse to the longitudinal axis of the rib.

14. The umbrella connecting device of claim 13, wherein the accommodating portion of the first arm comprises a recess formed in the inner wall of the first arm.

15. The umbrella connecting device of claim 14, wherein the accommodating portion of the second arm comprises a recess formed in the inner wall of the second arm.

16. The umbrella connecting device of claim 13, wherein the transverse member is configured to rotate within the first and second accommodating portions.

17. The umbrella connecting device of claim 13, wherein the connecting portion comprises a first segment extending along the connector and a second segment extending transverse to the first portion.

18. The umbrella connecting device of claim 17, wherein the second segment is disposed on a side of the connector to minimize deflection thereof.

19. The umbrella connecting device of claim 13, wherein the inner wall of the first arm comprises a groove extending from the first accommodating portion to an opening disposed away from the first accommodating portion.

20. The umbrella connecting device of claim 19, wherein a reinforcing segment is disposed on a side of the connector opposite the opening.

21. The umbrella connecting device of claim 13, wherein the rib comprises an aperture extending through the connecting portion, the aperture located within lateral extent of the first and second arms and configured to receive a fastener.

22. An umbrella connecting device, comprising:

a first arm comprising a first inner wall having a first lateral extent;

a second arm comprising a second inner wall positioned opposite to the first inner wall, the second arm having a second lateral extent;

a connecting portion located between the first inner wall and the second inner wall and connecting the first arm and the second arm, the connecting portion separating an upper rib space from a lower rib space; and at least one aperture extending through the connecting portion between the upper rib space and the lower rib space and within the first lateral extent of the first arm and within the second lateral extent of the second arm;

wherein a concave recess is embedded in the first inner wall and does not extend through to an outer side of the first inner wall.

23. The umbrella connecting device of claim 22, wherein the first inner wall includes a groove that extends from a location on an edge of the first inner wall, the groove extending toward the concave recess.

24. The umbrella connecting device of claim 23, wherein the groove that extends from a location spaced away from the connecting portion in a direction aligned with the connecting portion.

* * * * *